US009640051B2

(12) United States Patent
Conaty et al.

(10) Patent No.: US 9,640,051 B2
(45) Date of Patent: May 2, 2017

(54) SECURITY LOOP CABLE

(71) Applicants: Francis X. Conaty, Chester, NJ (US); Mark D. Ahlers, Columbus, NE (US)

(72) Inventors: Francis X. Conaty, Chester, NJ (US); Mark D. Ahlers, Columbus, NE (US)

(73) Assignee: Paige Electric Company, LP, Union, NJ (US)

( * ) Notice: Subject to any disclaimer, the term of this patent is extended or adjusted under 35 U.S.C. 154(b) by 0 days.

(21) Appl. No.: 14/803,854

(22) Filed: Jul. 20, 2015

(65) Prior Publication Data

US 2017/0024985 A1 Jan. 26, 2017

(51) Int. Cl.
*G08B 13/12* (2006.01)

(52) U.S. Cl.
CPC ..... *G08B 13/12* (2013.01)

(58) Field of Classification Search
CPC . G08B 13/12; G08B 13/1418; G08B 21/0288
USPC ..... 340/568.2–568.4, 540, 541
See application file for complete search history.

(56) References Cited

U.S. PATENT DOCUMENTS 6,337,633 B1 * 1/2002 Foseide ..... G08B 13/1418 340/540
7,327,276 B1 * 2/2008 Deconinck ..... G08B 13/1409 340/568.8
7,474,209 B2 * 1/2009 Marsilio ..... E05B 45/005 340/568.1
9,222,285 B1 * 12/2015 Ilislamloo ..... E05B 73/0017

* cited by examiner

*Primary Examiner* — Tai Nguyen
(74) *Attorney, Agent, or Firm* — Cook Alex Ltd.

(57) ABSTRACT

A security loop cable assembly is attached to the distal end of the main cable of an alarm system. The assembly has an enclosure with a main electrical connector inside the enclosure. The main cable terminates at the main connector. The enclosure releasably receives a polarized plug assembly that contains the ends of a loop cable. The plug assembly includes a housing and a case that are selectively joined. Inside the case two of the wires of the loop cable are permanently joined to opposite sides of an end-of-line resistor. The housing and case can be momentarily separated to thread one of them through an aperture in the protected object or gate. The plug assembly can be removably inserted into the enclosure, whereupon the main cable connector engages a loop connector to form an electrical circuit through the first and second wires and the end-of-line resistor.

20 Claims, 10 Drawing Sheets

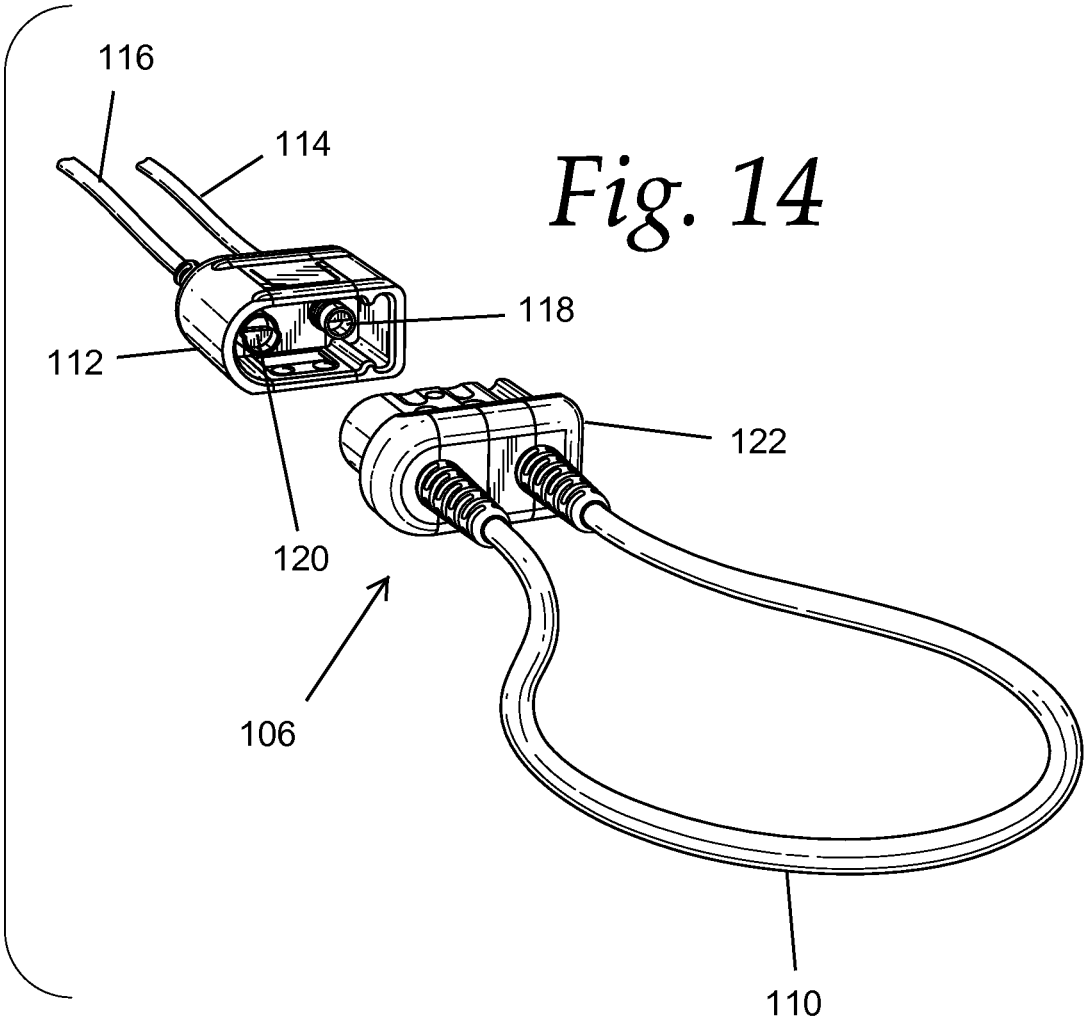
Fig. 14
Fig. 15
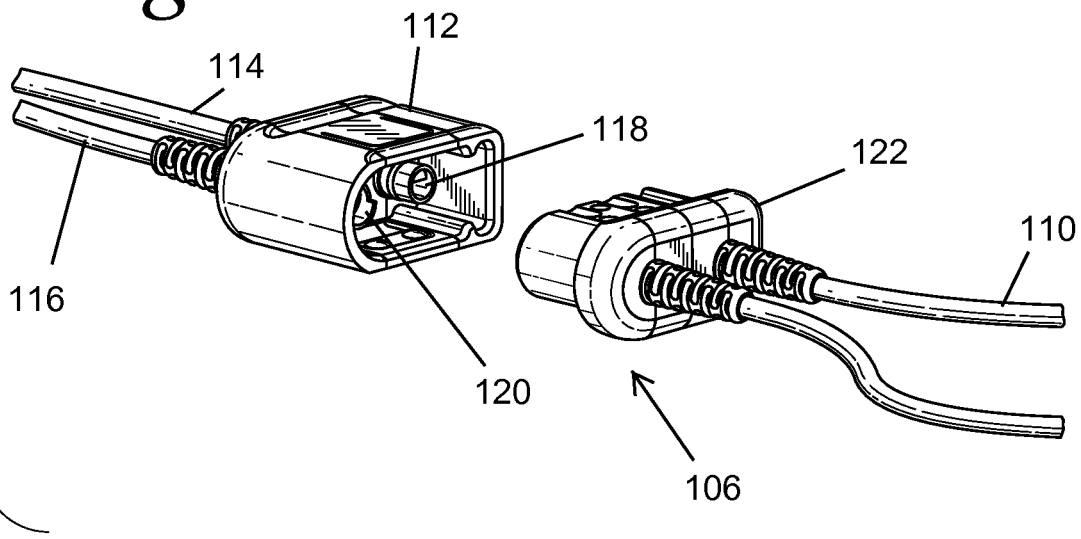

SECURITY LOOP CABLE

FIELD OF THE DISCLOSURE

The present disclosure is directed to electrical circuits for security alarms and is particularly directed to a security loop cable that provides physical security for objects and spaces.

BACKGROUND

Alarm circuits are used to provide physical security for objects and spaces. One type of alarm circuit includes a base or control station to which one or more main electrical cables are electrically connected. The main cables extend from the base station to a point where they are physically connected by a security loop cable to an object or a gate. The gate typically governs entry to a secured space. The distal end portion of the main cable is mechanically and electrically connected to a security loop cable which is physically secured to the object or gate. Physical attachment of the security loop cable to the protected item is accomplished by threading a momentarily free end of the security loop cable through an opening in the object or gate and then looping the cable back toward itself where it is releasably fastened to either itself or the main cable or an extension of the main cable. The looped end portion of the security loop cable is sometimes referred to as a pigtail. With the pigtail looped around the object or gate, the object or gate cannot be moved without causing separation of the security loop from the remainder of the cable, thereby triggering the alarm circuit.

When authorized personnel need to move a secured object or open a secured gate they have to first deactivate the alarm circuit at the base station and then disconnect the security loop cable from the object or gate. In the case of a gate, once the authorized personnel pass through the gate it is reclosed, the security loop cable is reattached to the main cable and the alarm circuit is reactivated to resume protection of the gate.

If unauthorized parties attempt to move the object or gate, they will typically do so by either cutting the security cable or unfastening the security loop. The less skillful unauthorized parties won't even notice the cable and their attempt at forced movement of the object or gate will either unintentionally disconnect the security loop from the main cable or simply break one of the cables at some point. In any case, since either of these is done without deactivation of the alarm circuit, this break in the electrical continuity of the cable is sensed at the base station and triggers an alarm condition at the base station so that appropriate actions can be taken. Such actions include alerting security personnel so they can respond, turning on audible sirens, turning on lights, aiming a camera at the affected area, or some combination of these or related actions.

Economic considerations dictate that only a single main cable extends from the base station to the protected object or gate, although the single cable may have multiple insulated wires within it. Further, an alarm system of the type described requires selective fastening and unfastening of a security loop or pigtail at the end of the main cable such that the security loop can be selectively threaded through a gate or a portion of a protected object to prevent movement thereof without deforming the loop.

In the past the connectors for forming the security loop have been inadequate in several respects. Most notably they fail to disconnect reliably when under stress without damage to the connector. This comes into play because even conscientious authorized personnel have been known to forget to disconnect the security loop. When the gate or object is moved with the security loop still attached, it would be preferable for the security loop connector to disconnect without destroying either the connector or cable, i.e., it should disconnect in a safe, non-destructive manner. Of course, unless the alarm circuit was deactivated first, even a safe, non-destructive disconnection will still trigger an alarm. But with a safe, non-destructive disconnection, after all the tumult of a triggered alarm has been ironed out, authorized personnel can simply reconnect the security loop without repair or replacement.

It has also been found that in the past security loop connectors have unfortunately had the ability to confound authorized personnel as to their proper connection. Thus, attempts to reconnect the security loop fail to make the proper electrical connection, with the result that the base station cannot reset the alarm circuit and place it in operative mode. Aggravation over failed connections may eventually lead authorized personnel to make an unauthorized decision to stop using the alarm circuit altogether.

SUMMARY

In one aspect, the device of the present disclosure addresses the foregoing issues by providing a security loop cable assembly having connectors that are self-evident how to connect and disconnect. Further, the connectors will disconnect when forced without damage to the connectors or cables. In one embodiment the security loop cable assembly has an enclosure and the distal end of the main cable is attached to an electrical connector inside the enclosure. The enclosure releasably receives therein a polarized plug assembly that contains the two ends of the loop cable. A proximal end of the loop cable is permanently attached to an electrical connector which is inside a housing. The other or distal end of the loop cable is contained inside a case. Inside the case two of the wires of the loop cable are permanently joined to opposite sides of an end-of-line resistor. The housing and case can be selectively joined together to form a plug assembly. The housing and case can be momentarily separated from one another for the purpose of threading one of them through an existing aperture in an object or gate. They are thereafter joined together to form the plug assembly. The plug assembly can be removably inserted into the enclosure. When that is done the main cable connector engages the loop connector to form an electrical circuit through the first and second wires and the end-of-line resistor.

In an alternate embodiment the main cable connects to a Y-splitter which has first and second output legs. The ends of the output legs each have a connector attached thereto. Inside the Y-splitter a first wire of the main cable is fed to the first leg and its connector. Also inside the Y-splitter a second wire of the main cable is fed to an end-of-line resistor, the other side of which extends to the second output leg and its connector. A loop cable has connectors on each end that mate with the connectors on the first and second output legs. The wires in the loop cable are arranged such that one wire in the loop cable electrically connects the first wire of the main cable to the second wire of the main cable, via the end-of-line resistor.

BRIEF DESCRIPTION OF THE DRAWINGS

FIG. 14 is a perspective view of the loop cable of FIG. 11, looking into the into the enclosure with the plug assembly retracted from the enclosure.

FIG. 15 is similar to FIG. 14, looking into the enclosure from a different angle.

DETAILED DESCRIPTION OF THE EMBODIMENTS

Figure 1:
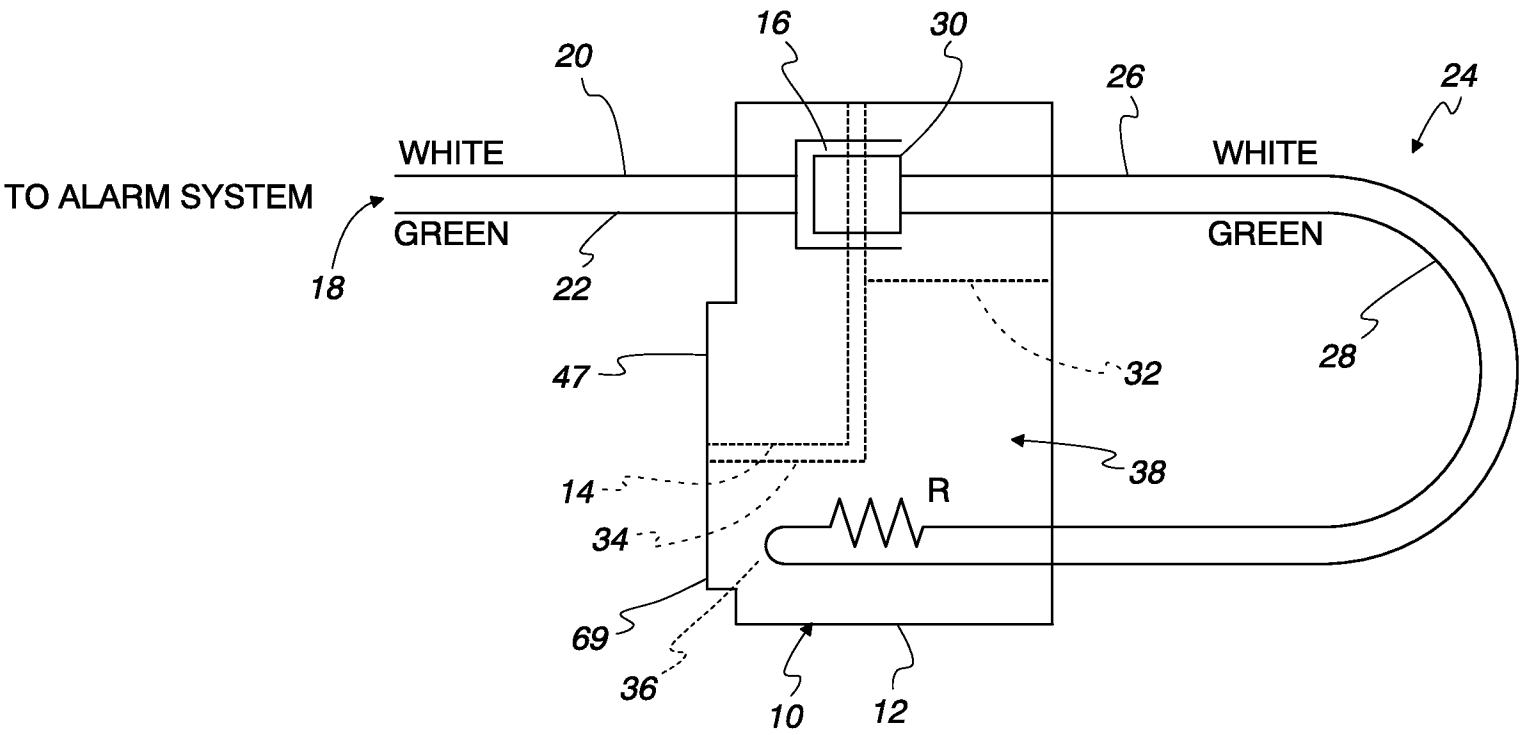
FIG. 1 is an electro-mechanical diagram of a first embodiment of the security loop cable assembly of the present disclosure.

FIG. 1 illustrates an electro-mechanical diagram of a first embodiment of the security loop cable assembly of the present disclosure at 10. The security loop cable assembly includes a loop-receiving element in the form of an enclosure 12 that is generally hollow except at an internal block, indicated schematically at 14. The block 14 receives therein a main connector shown at 16. The main connector 16 may be of the type shown and described in U.S. patent application Ser. No. 14/171,417, filed Feb. 3, 2014, the disclosure of which is incorporated herein by reference in its entirety. The main connector 16 is fixed to the distal end of a main cable 18. The main cable includes at least two individual, insulated wires 20 and 22. In this instance the wires 20 and 22 are labeled white and green, respectively, after the typical colors of their insulation. In this diagram the individual wires 20 and 22 are shown but the outer jacket of the main cable that contains the individual wires is omitted for clarity. Also omitted are any additional wires or components that may be provided for mechanical strength but are not involved in the electrical circuit. Also, the terms distal and proximal are used herein with respect to a base station of an alarm system. Thus, the proximal end of the main cable or loop cable is the end closest to the base station while the distal ends of said cables are the ends farthest from the base station.

A loop cable or pigtail 24 includes a white wire 26 and a green wire 28. The loop cable will also include a protective outer jacket (not shown) and optionally may have additional wires or other members to enhance its mechanical strength. The proximal end of the loop cable 24 is fixed to a loop connector 30. The loop connector is embedded in a housing 32 and is releasably electrically and mechanically engageable with the main connector 16. Thus, the loop connector 30 is preferably also of the type shown in U.S. patent application Ser. No. 14/171,417, filed Feb. 3, 2014. While the diagram of FIG. 1 suggests the main connector 16 is a female connector and the loop connector 30 is a male connector, it will be understood that the arrangement could be reversed. Or the two connectors could each have male and female components, as well as internal polarizing features, as shown in the referenced U.S. patent application Ser. No. 14/171,417. In any event, the connectors 16 and 30 allow for releasable electrical engagement of the white and green wires 20, 22 of the main cable 18 with the white and green wires 26, 28, respectively, of the loop cable 24.

The distal end of the loop cable 24 is held fixed in a loop-closure element. In this embodiment the loop-closure element takes the form of a case 34. Both the case 34 and the housing 32, as well as the enclosure 12, may be made of suitable high-strength plastic material. The case includes a polarizing extension or prong 36 that extends adjacent to the block 14 in the enclosure 12 when the case 34 is placed in the enclosure.

Inside the case 34 the distal ends of the white and green wires 26, 28 of the loop cable 24 are attached to opposite ends of an end-of-line resistor R. Thus, the white and green wires are connected to each other through the resistor R. When the alarm circuit is enabled and in operative mode a typical arrangement is to periodically impose at the base station a voltage or current on one of the wires and monitor the response on the other wire. Any interruption of the electrical continuity of the two wires will result in an unexpected reading and will be considered an alarm condition unless the base unit was first disabled and put in a standby mode.

Physical securement of the loop cable 24 to the protected object or gate is preferably effected without any alteration of the object or gate. That is, it is desirable that no clamps, locks, snaps, hooks or other devices be added to the object or gate for the purpose of retaining the loop cable fixed thereto. The present disclosure accomplishes this by threading the loop cable through an existing aperture in the object or gate, reversing the loop cable back on itself and securing it either to itself, to the main cable or to a member attached to one or both of these. Thus, the housing 32 and case 34 are releasably connectable to one another. When joined together they form a plug assembly 38 that can be inserted into the enclosure 12 as a unitary member. When separated from one another, one of the housing 32 or case 34 can be threaded through an aperture in a protected object or gate and then the loop cable is turned back on itself so the housing and case can be rejoined to create the plug assembly 38. The polarizing prong 36 assures that the plug assembly is inserted into the enclosure 12 in the proper orientation to assure proper connection of the main connector 16 and the loop connector 30. These mechanical features will now be described in further detail.

Figure 2:
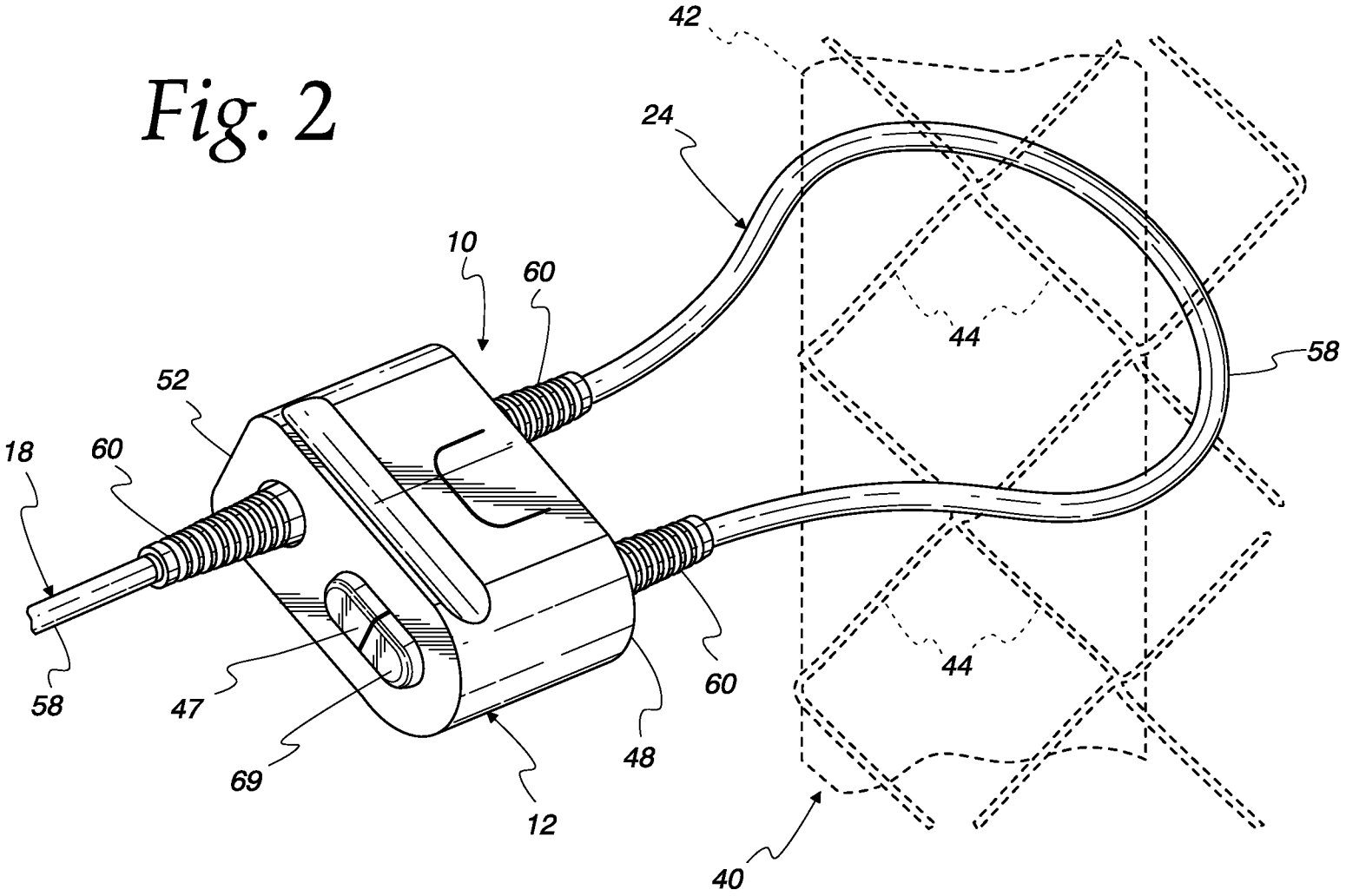
FIG. 2 is a perspective view of the security loop cable assembly installed on a gate.

FIG. 2 shows the security loop cable assembly 10 installed on a gate 40. The gate includes a movable post 42 to which fencing 44 is attached. The loop cable 24 is threaded around the post 42 and through an aperture in the fencing 44. The plug assembly 38 is shown inserted in the enclosure 12. The enclosure may typically be mounted on a fixed portion of fencing (not shown) or on a building or other immovable structure, although such mounting is not required. With the enclosure 12 fixed and the loop cable 24 secured to the gate 40, the only way to move the gate is to remove the plug assembly 38 from the enclosure 12 so the loop cable 24 can move with the gate. Such removal of the plug assembly will trigger the alarm circuit if the removal is done without an authorized disarming of the alarm circuit.

Figure 3:
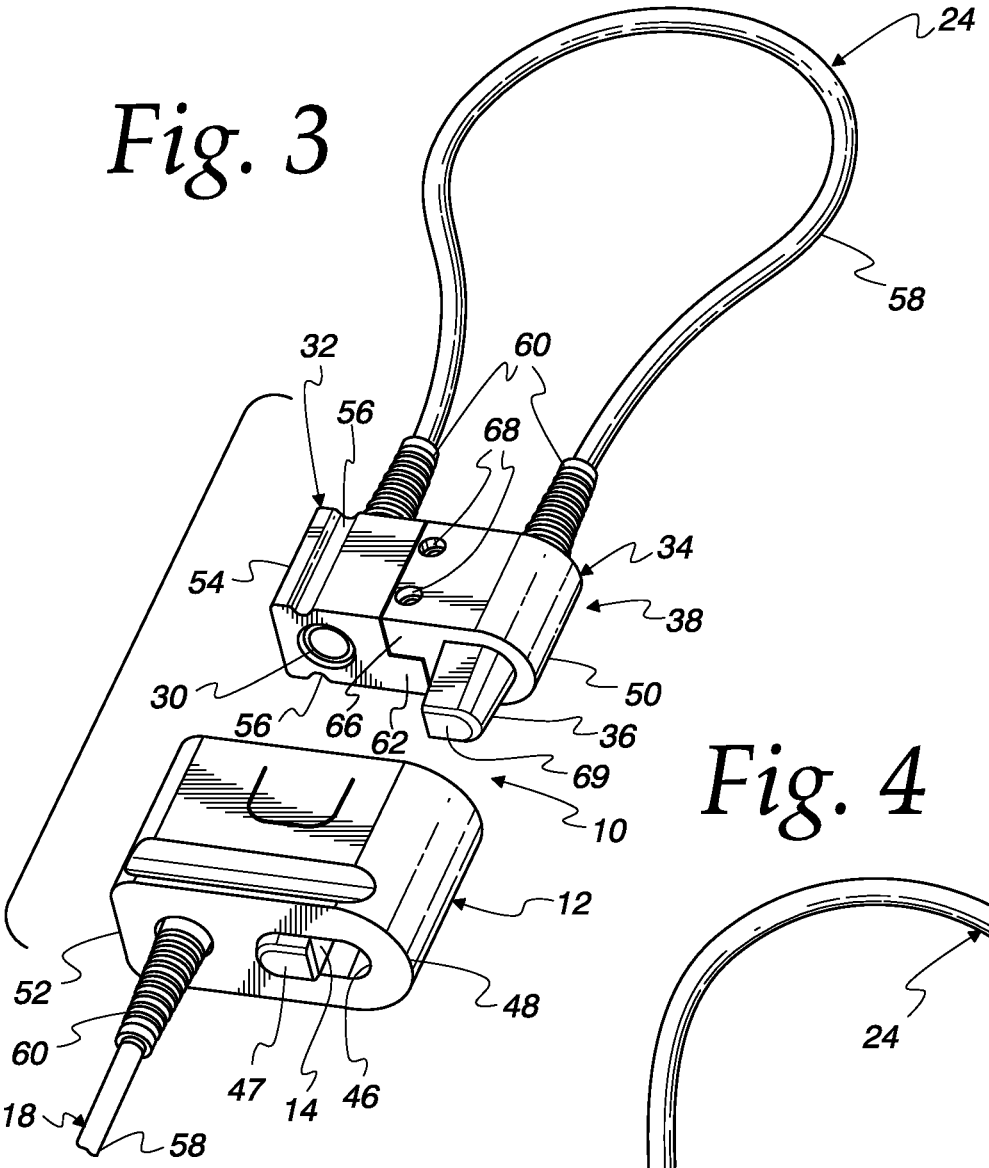
FIG. 3 is an exploded perspective view of the loop cable and plug assembly removed from the enclosure, which is attached to the main cable.

FIG. 3 illustrates the plug assembly 38 removed from the enclosure 12. A protruding portion of the enclosure's internal block 14 is visible adjacent to an opening 46. The protrusion defines a comparison surface at 47. The prong 36 fits into the enclosure 12 adjacent the block 14 and extends slightly from the opening 46. Interference between the prong 36 and the block 14 assures that the plug assembly 38 can be inserted into the enclosure only in the correct orientation that will properly align the main connector 16 and the loop connector 30. Additional polarizing features include a rounded edge 48 on the enclosure 12 that mates with a corresponding rounded edge 50 on the housing 32. The rounded edges contrast with flat edges 52 and 54 on the opposite sides of the enclosure 12 and case 34. Further, the top and bottom surfaces of the housing 32 have grooves 56. The grooves mate with projections (not shown) on the interior of the enclosure 12 and in front of the internal block 14. Thus, the polarizing features include the prong 36 and internal block 14, the round edges 48, 50, the flat edges 52, 54 and the grooves 56 and projections. Taken together these features assure correct orientation of the plug assembly 38 upon insertion into the enclosure 12.

Additional features shown in FIG. 3 include an end portion of the loop connector 30. Outer insulating jackets 58 are shown for the main cable 18 and the loop cable 24. All of the cable ends are provided with strain relief members 60.

Figure 4:
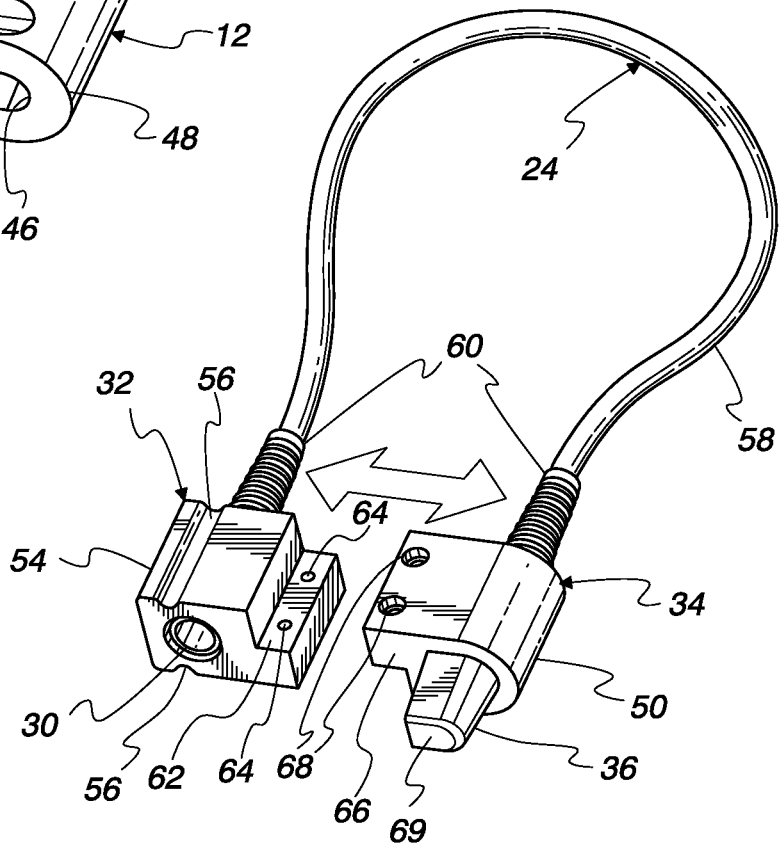
FIG. 4 is a perspective view of the loop cable showing the plug assembly disassociated into its constituent components, namely, the housing and the case.
Figure 7:
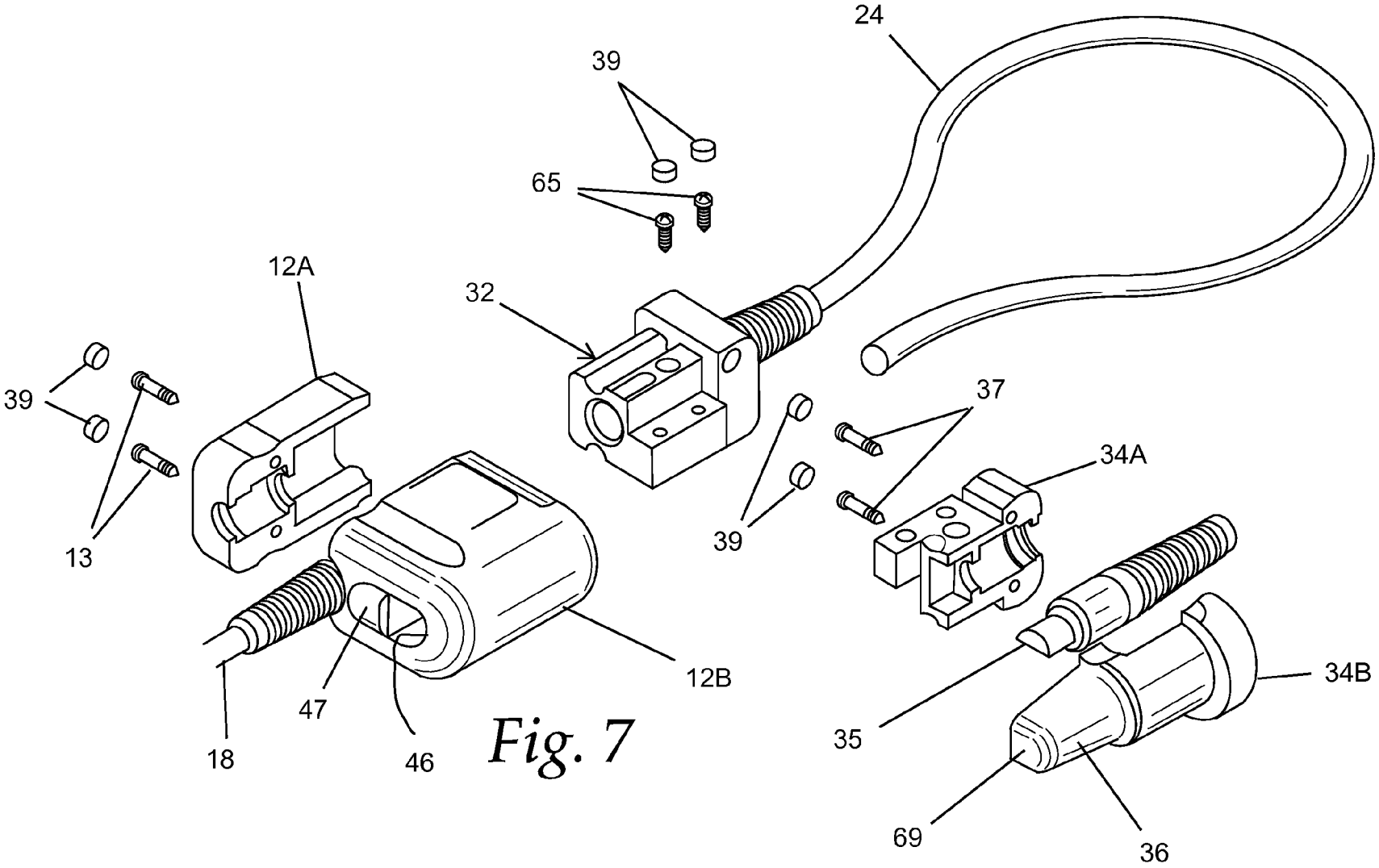
FIG. 7 is an exploded perspective view of the loop cable and plug assembly

FIG. 4 illustrates the loop cable 24 with the housing 32 separated from the case 34. The housing has a shoe 62 extending along a lower half of the edge adjoining the case. Screw holes 64 are formed in the shoe. The case has a similar ledge 66 extending along an upper half of the edge adjoining the housing. The ledge also has screw holes 68. When the ledge and shoe are placed next to each other, as in FIG. 3, the screw holes 64 and 68 align and screws 65 (FIG. 7) are placed therein to hold the housing 32 and case 34 together to form the plug assembly 38. When the screws are removed, the housing 32 and case 34 can be separated from one another as seen in FIGS. 4 and 7. This will allow one of the housing or case to be threaded through an aperture in a protected object or gate, after which the housing and case are placed next to each other and the screws replaced, thereby securing the loop cable to the protected object or case. The plug assembly 38 can then be inserted into and removed from the enclosure 12 as needed to move the protected object or gate.

Figure 5:
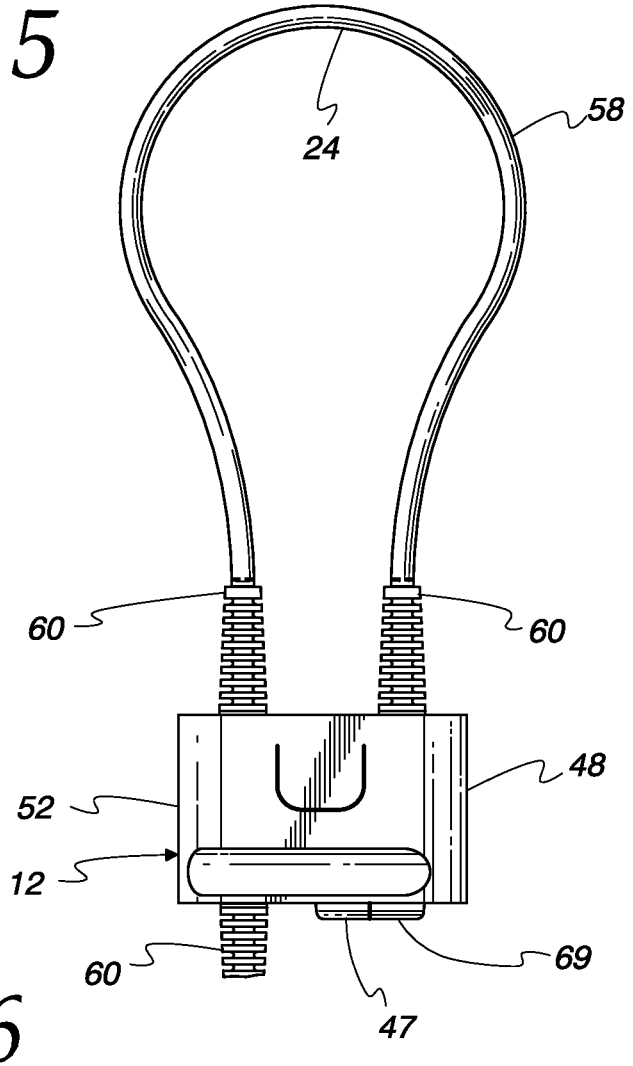
FIG. 5 is a top plan view of the security loop cable having its plug assembly fully inserted into the enclosure.
Figure 6:
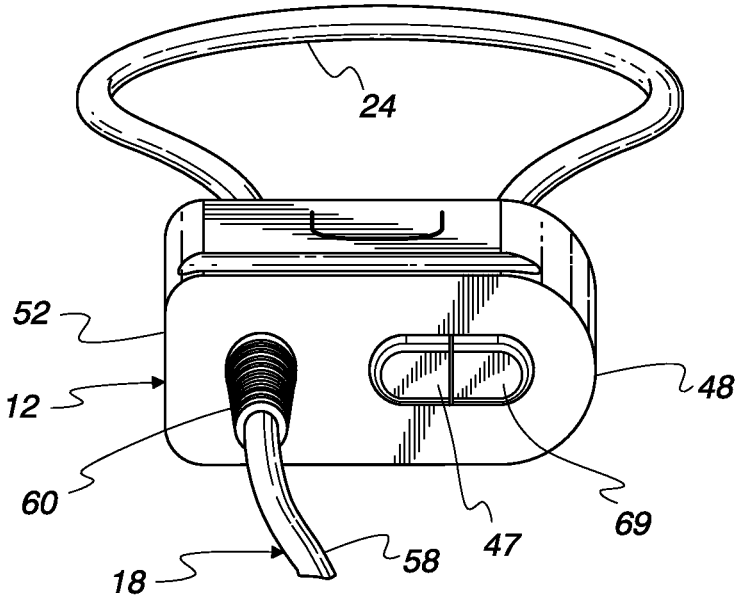
FIG. 6 is an end perspective view of the enclosure with the security loop's plug assembly installed therein.

FIGS. 5 and 6 illustrate further views of the security loop cable installed in the enclosure. These figures particularly show a comparison surface 69 defined on the end of the prong 36. When the plug assembly is fully seated in the enclosure, the comparison surface 69 extends out through the opening 46 on the main cable side of the enclosure 12 and aligns in essentially co-planar relation with the comparison surface 47. Thus, when the comparison surfaces 47 and 69 are co-planar the user can be assured that there is full seating of the loop connector 30 with the main connector 16 inside the enclosure 12. Further, the comparison surface 69 also serves as a location where an assist can be provided for decoupling the plug assembly 38 from the enclosure 12. That is, a user may optionally press on the comparison surface 69 protruding from the enclosure to start the movement of the plug assembly out of the enclosure.

FIG. 7 illustrates further details of the construction of the enclosure 12, housing 32 and case 34. As seen here the enclosure may be formed in two halves, 12A and 12B. The halves are arranged to trap the main connector 16 therebetween. Screws 13 hold the enclosure halves 12A, 12B together. Similarly, case 34 may be split into two case halves 34A and 34B with a terminal connector 35 therebetween. The terminal connector houses the end-of-line resistor R. Screws 37 hold the case halves 34A, 34B together. The case halves are joined prior to joining the case 34 to the housing 32. It will be noted that if the openings in a gate or protected device are too small to accommodate the entire case, the case halves could be separated to allow just the terminal connector 35 to be threaded through the opening. Then the case halves would be screwed back together and the entire case would be joined to the housing 32 to complete the security loop. It will also be noted that while it is not shown in FIG. 7, the housing 32 could be split into halves, similarly to enclosure 12 and case 34, and held together by screws. After installment of the screws, all of the screw openings could be capped by plugs 39 or the like to discourage unauthorized access to the screws.

Figure 8:
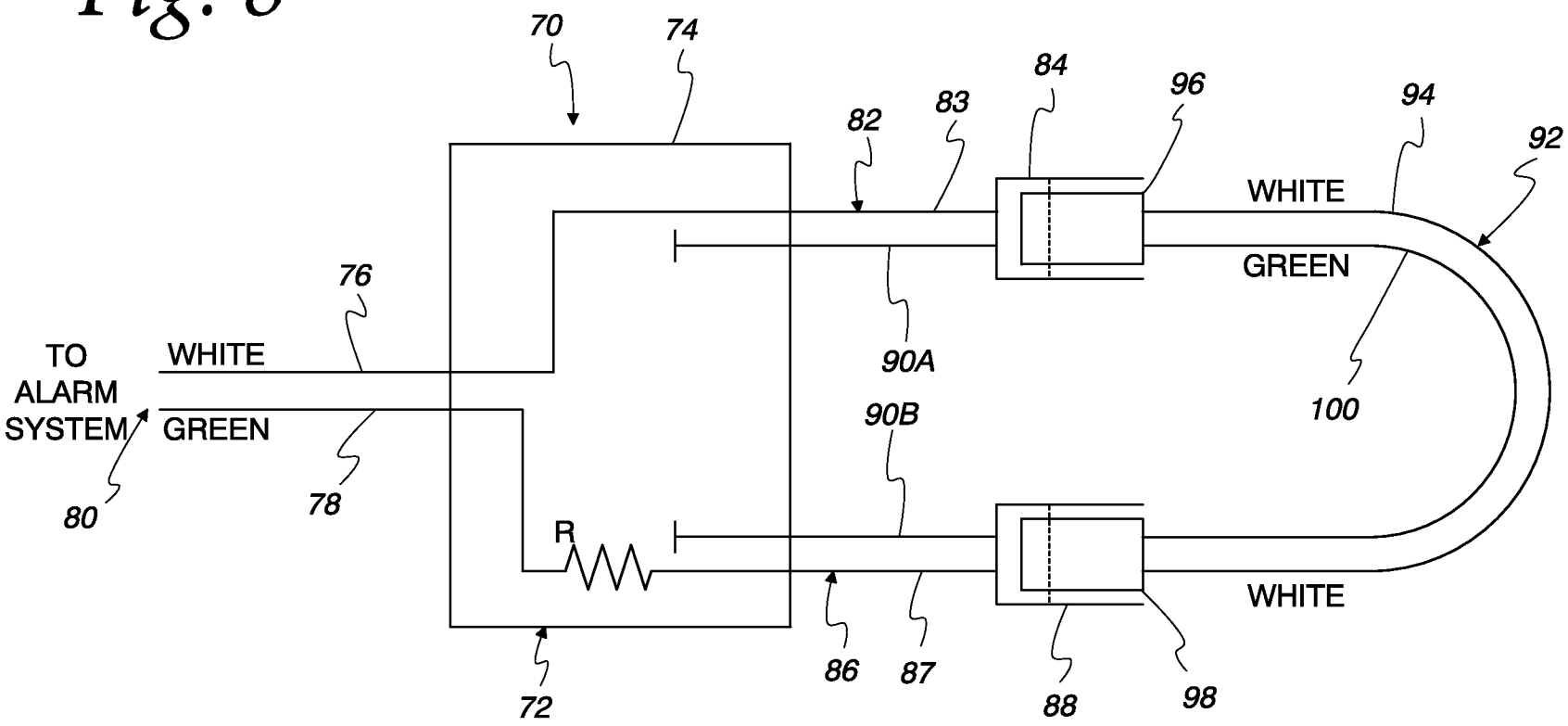
FIG. 8 is an electro-mechanical diagram of a second embodiment of the security loop cable assembly of the present disclosure.

FIG. 8 illustrates an alternate embodiment of the disclosure. Here the security loop cable assembly shown generally at 70 includes a loop-receiving element in the form of a Y-splitter 72 with a pair of output legs. The Y-splitter has a housing 74 which receives at least the white and green wires 76, 78 of a main cable 80. Inside the housing 74 the white wire 76 is connected to a first output leg 82 which includes at least an active wire 83. The first output leg extends out of the housing and terminates at a main connector 84. The green wire 78 is connected inside the housing 74 to a resistor R. The other side of the resistor R is connected to a second output leg 86. The second output leg also includes an active wire 87 and extends out of the housing 74 and terminates at a second connector 88. Both output legs 82, 86 may optionally include one or more additional wires or other elongated members 90A, 90B that have no part in the electrical circuit but are provided for mechanical strength.

A loop cable 92 has at least a white wire 94 connected at a proximal end to a first loop connector 96. The distal end of the white wire 94 has a loop-closure element in the form of a second loop connector 98. The first and second loop connectors 96, 98 are selectively engageable with the main and second output leg connectors 84 and 88, respectively. The loop cable 92 will typically include more than a single wire. A green wire is shown at 100 in the loop cable. This wire does not participate in the electrical circuit but is provided for mechanical strength.

The proximal end of the white wire 94 of the loop cable 92 is arranged to electrically connect through first loop connector 96 and the main output leg connector 84 and the first output leg's active wire 83 to the white wire 76 of the main cable 80. The distal end of the white wire 94 of the loop cable 92 is arranged to electrically connect through second loop connector 98 and the second output leg connector 88 and the second output leg's active wire 87 and the resistor R to the green wire 78 of the main cable 80. Thus, this electrical circuit operates similarly to the circuit of FIG. 1 in that it connects the white and green wires of the main cable 80 through a resistor R.

The difference in the two embodiments lies in the manner of forming the security loop. In FIG. 1 the loop-receiving element is the enclosure 12 that receives the plug assembly 38. The loop-closure element is the case 34 that creates the loop by fastening the ends of the loop cable together by means of the screws 65 that hold the housing 32 and case 34 together. In FIG. 8 loop-receiving element is the Y-splitter 72 and its output legs 82, 86 with their connectors 84, 88 on the distal ends. The loop-closure element is the second loop connector 98. Selective interruption of the loop is achieved through the dual connector pairs 84, 96 and 88, 98 that are provided within the loop itself.

Figure 9:
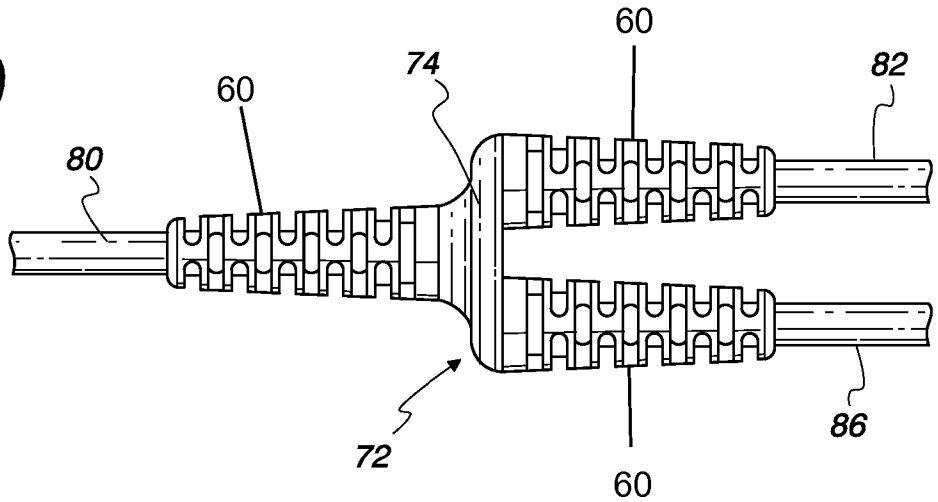
FIG. 9 is a side elevation view of the Y-splitter of the FIG. 8 embodiment.

FIG. 9 shows a plan view of the Y-splitter 72 with the main cable 80 connected through strain relief member 60 to the housing 74. Two strain relief members 60 for the first and second output legs 82, 86 are provided on the side of the housing opposite the main cable 80.

Figure 10:
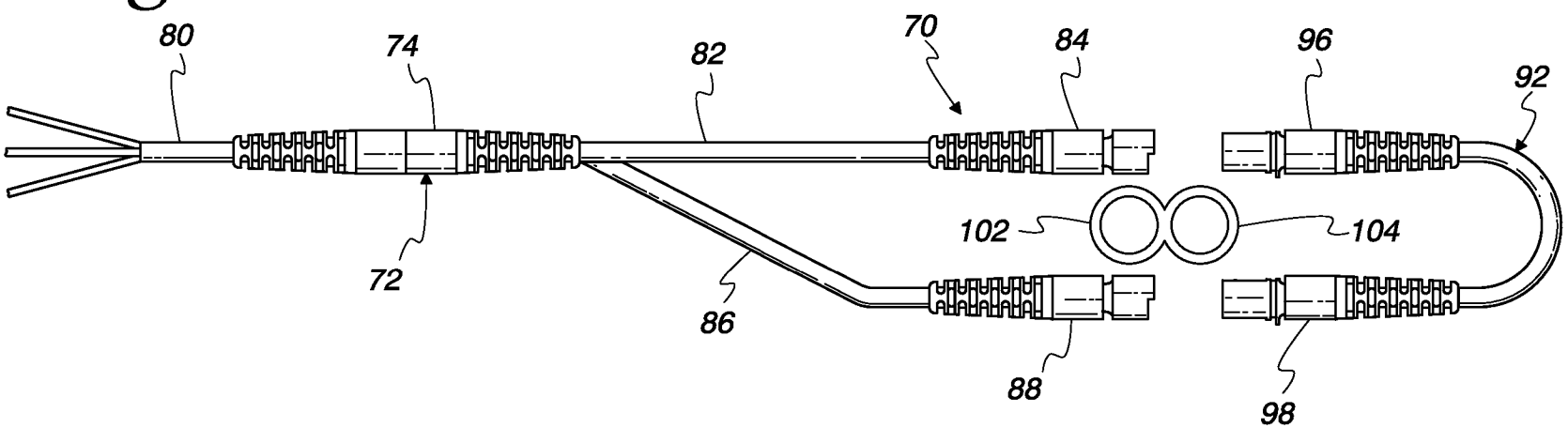
FIG. 10 is a schematic plan view of the security loop cable assembly of FIG. 8 applied to a gate, with one of the output legs moved out of the plane of the Y-splitter housing to illustrate the dual output legs of the Y-splitter.

FIG. 10 includes a schematic representation of the security loop cable assembly 70 as it might be applied to a gate. A stationary gate post is shown at 102. The Y-splitter 72 is mounted on or near the stationary post 102, perhaps on fencing secured to the post. The connectors 84, 88 of the first and second output legs 82, 86 are then located in the vicinity of the stationary post, somewhere close enough to permit the loop cable 92 to engage the connectors 84, 88 while the loop cable is wrapped around a movable post 104 of the gate. With this arrangement and with the connector pairs 84, 96 and 88, 98 engaged, moving the gate 104 would require disabling the alarm system and then disconnecting one or both of the connector pairs. If one connector pair is disconnected then that end of the loop cable would have to be unthreaded from the gate. If both connector pairs are disconnected, then the loop cable could remain threaded on the gate and move with the gate.

Figure 11:
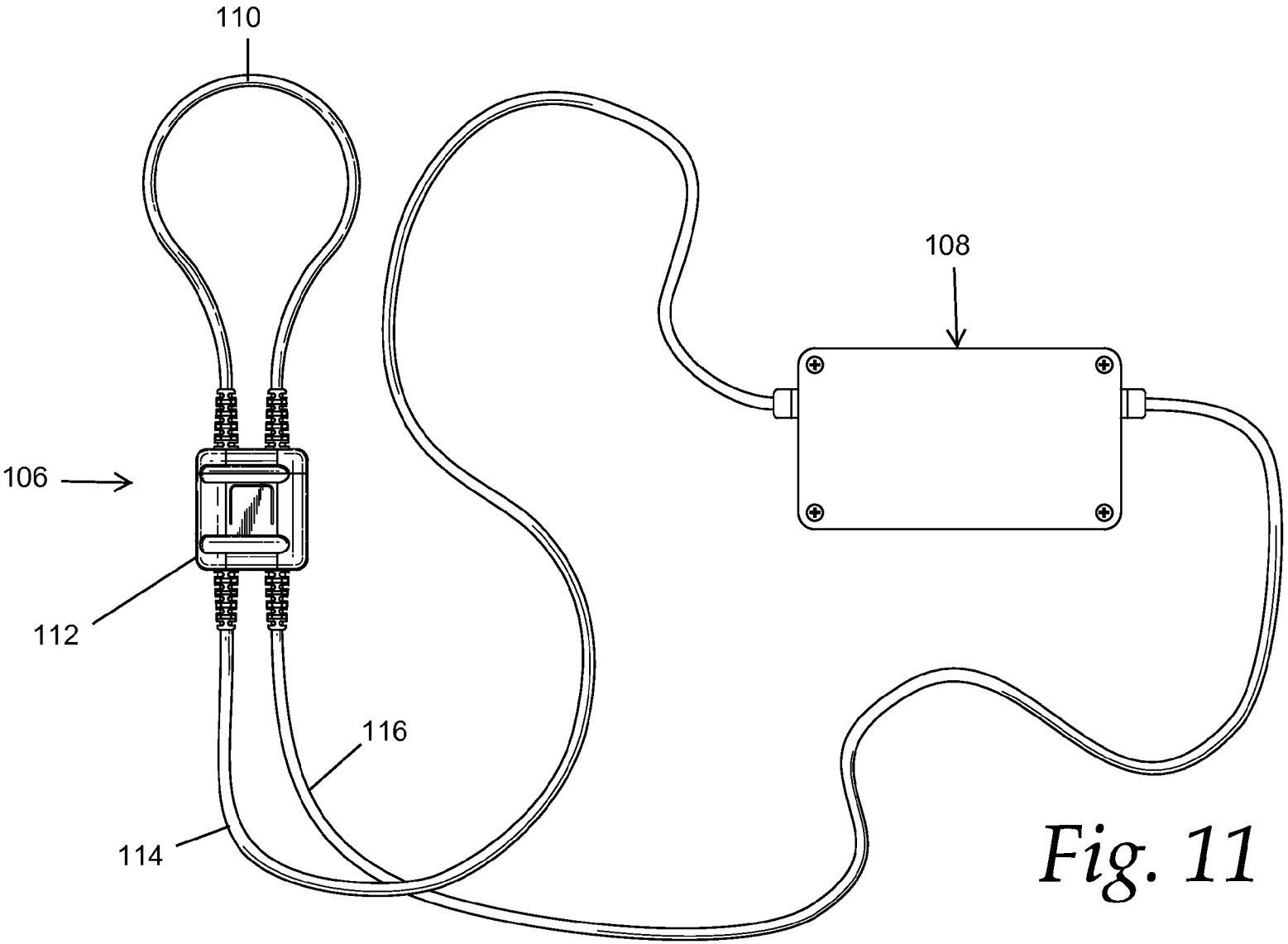
FIG. 11 is a plan view of a third embodiment of the loop cable and plug assembly connected to a mobile communications unit.
Figure 12:
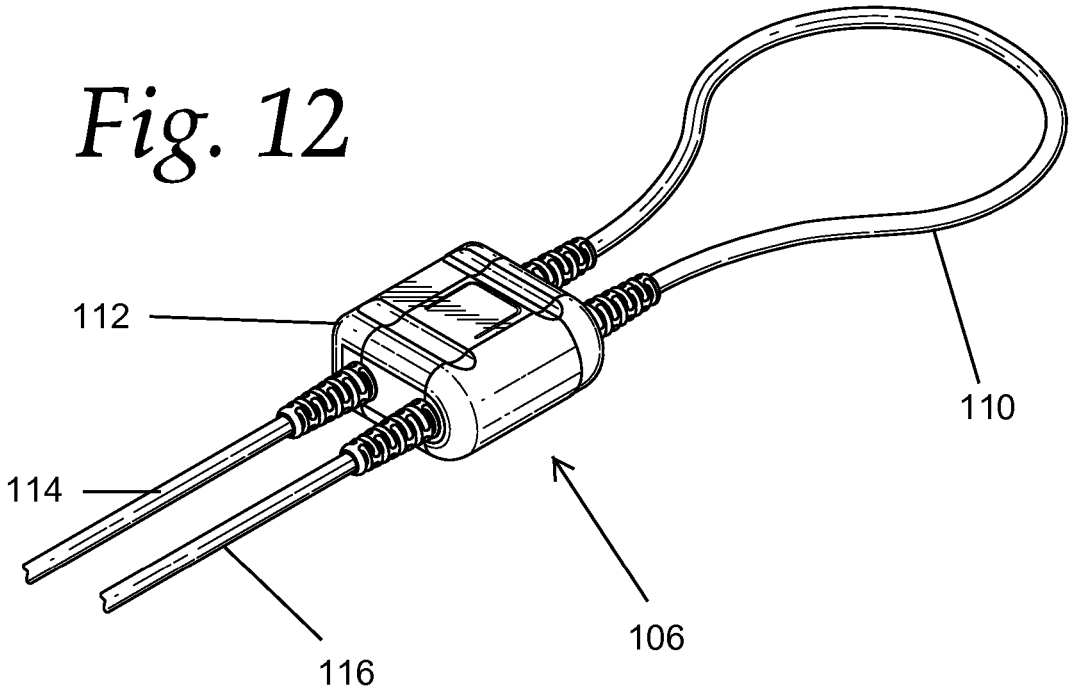
FIG. 12 is a perspective view of the loop cable of the assembly of FIG. 11.
Figure 13:
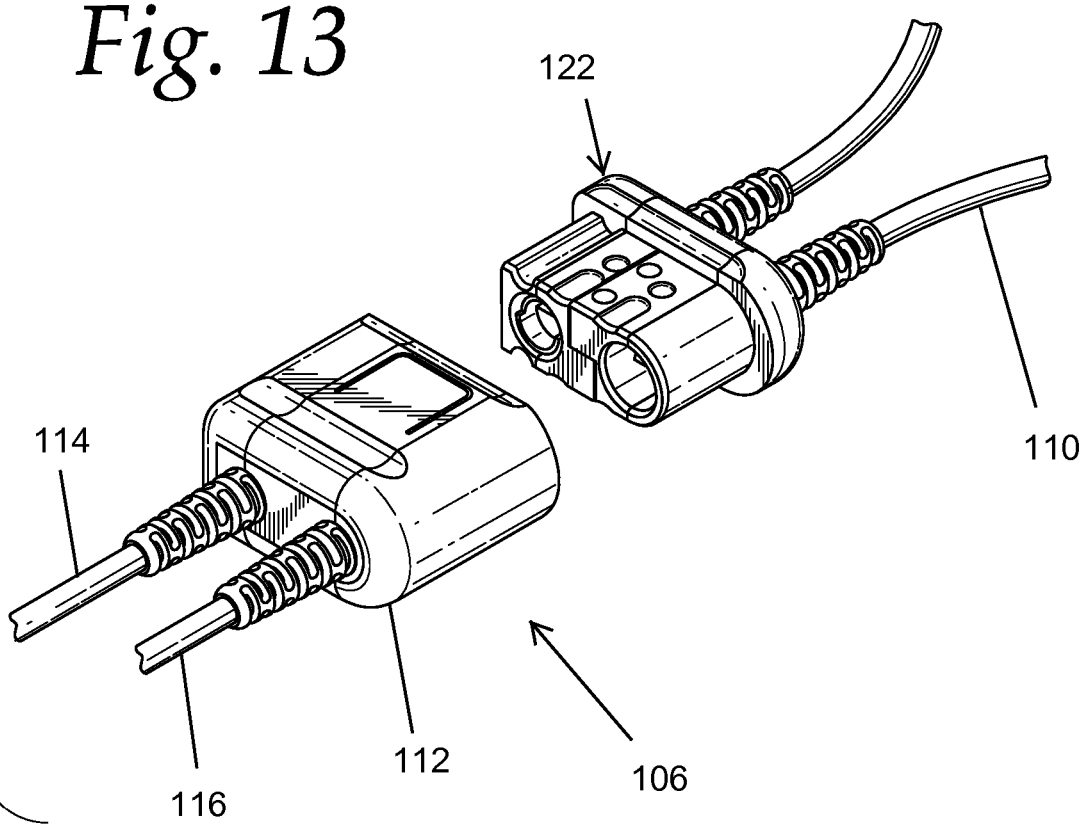
FIG. 13 is similar to FIG. 12 but with the plug assembly retracted from the enclosure.

FIG. 11 illustrates a further alternate embodiment of a security loop cable assembly 106. This embodiment may be considered a mobile security loop cable in that it substitutes a wireless communication device 108 for the main cable used in the previous embodiments. Thus, it can be used in locations where it is preferred not to use a main cable to connect the security loop to a base station. The wireless communication device 108 may use radio frequency communications or cellular telephone technology or other means to communicate with a base station. By way of example only, and not by limitation, a wireless communication device such as that sold by Net Irrigate LLC of Bloomington, Ind. under their registered trademark Wire Rat® may be a suitable wireless communication device. This device has a self-contained battery and is capable of sending signals testing the continuity of an electrical circuit. If a fault in the circuit is detected, the wireless device 108 uses cellular communications to notify an appropriate base station of the fault.

The security loop cable assembly 106 includes a loop cable 110 which is similar to loop cable 24. A loop-receiving element in the form of an enclosure 112 has connectors in it that releasably join mating connectors on the ends of the loop cable 110. The enclosure further includes connectors that mate with first and second local cables 114 and 116. The local cables are relatively short, ranging from about a foot to several feet. They need only be long enough to permit convenient location and mounting of the communication device 108 on a permanently immovable object near the protected object or gate, e.g., on a fixed gate post or section of fence.

FIGS. 12-15 illustrate further details of the enclosure 112 and its interface with the loop cable 110. One difference between enclosure 112 and enclosure 12 is instead of one connector therein, enclosure 112 has two connectors therein, one for each of the local cables 114 and 116. These connectors may be similar to the connectors described above and are best seen at 118 and 120 in FIG. 14.

A plug assembly 122 has connectors therein (not shown) which are releasably engageable with connectors 118 and 120 in the enclosure. When the plug assembly 122 is inserted into the enclosure 112 the plug connectors will mechanically and electrically engage the enclosure connectors 118, 120. This provides electrical continuity from the communications device 108 to the first local cable 114, through connector 118 and its mate in the plug assembly, through the loop cable 110 to the other plug assembly connector and its mate 120, to the second local cable 116 and back to the other side of the communication device.

The plug assembly 122 may have a similar arrangement to plug 38 in that it may have separable housing and case components. Separation of the housing and case permits threading one of them through an opening in a protected object or gate. After threading the housing and case are rejoined, thereby fixing the loop cable 110 to the protected object or gate. Once the plug assembly 122 is inserted in the enclosure and the electrical connections are made therein, the device is ready for operation.

The mobile security loop cable is well-adapted for use in protecting the doors of shipping containers. The communication device 108 is mounted on the top or side of the container and the security loop 110 is threaded through both of the doors. Any unauthorized opening of the doors will result in triggering the communication device 108 to send a cellular call to the base station. Alternately, the enclosure 112 could be fixed to one door and the loop 110 threaded through only the other door. This arrangement would permit authorized opening of the doors by separating the plug assembly from the enclosure and allowing the loop cable 110 to remain threaded in the one door.

A further alternate arrangement would be to remove the loop cable 110 and enclosure 112. Instead of these components, the first and second local cables 114 and 116 would connect to magnetic contact sensors mounted on the shipping container's doors. When the doors are closed the magnets are in close enough proximity to each other (physical touching is not required) to complete the electrical circuit through the local cables. If you open the doors without disconnecting the circuit it sets off the alarm. Magnetic contact sensors are available from, for example, Sentrol, Inc. and shown in U.S. Pat. No. 5,777,552, the disclosure of which is incorporated herein by reference.

The security loop cable assembly of the present disclosure provides a structure that can be forced open without destruction of the assembly. It is a weather and sunlight resistant structure that prevents corrosion of the internal electrical contacts. Its presence on a protected object or gate provides a visual deterrent to unauthorized parties contemplating moving the object or gate. The security loop cable assembly provides for a quick and easy retrofit installation. The end-of-line resistor can have a selected value that will permit the base station to identify a particular gate or protected object.

A further alternate embodiment is a hybrid of FIGS. 1 and 8 in that it uses the electrical circuit of FIG. 1 and the mechanical arrangement of FIG. 8. In this alternate embodiment the internal wiring of the Y-splitter 70 would be altered from that shown in FIG. 8 such that connection of the green wire 78 of the main cable to the resistor R is removed and replaced with a connection of the green wire 78 to the wire 90A of the first output leg 82. Also, the wire 90B of the second output leg 86 would be connected to the left side (as seen in FIG. 8) of the resistor R. In this case the green wire 100 of the loop cable 92 would play an active role in the electrical circuit, the same as it does in the FIG. 1 circuit.

It should be understood that various changes and modifications to the presently preferred embodiments described herein will be apparent to those skilled in the art. Such changes and modification can be made without departing from the spirit and scope of the invention disclosed herein. For example, while the security loop cable assembly of FIG. 1 shows the housing and case normally joined to one another to form a plug assembly 38 that is selectively engageable as a unit with the enclosure, alternatively it could be arranged such that one of the housing and case could be removed from the enclosure while the other of the housing and case would remain in the enclosure. Such an arrangement would be closer to that of the FIG. 8 embodiment in that the one of the housing and case that is removed from the enclosure would have to be unthreaded from the protected object or gate to allow the other of the housing or case to remain in the enclosure while the protected object or gate is moved. A further alternate embodiment may include a circuit wherein the end-of-line resistor is not present, as it is not always necessary. The hard-wired version of the security loop cable concerns a completed circuit being disturbed regardless of the presence of an end-of-line resistor. Thus, it will be understood that it is possible to leave the end-of-line resistor out of the circuit.

The invention claimed is:

1. In an alarm system having a base station connected to a main cable having at least first and second wires, a security loop cable assembly comprising:

an enclosure having at least one aperture for receiving the wires of the main cable therein;

a main connector electrically connected to at least one the wires of the main cable;

a loop cable having proximal and distal ends;

a loop connector attached to the proximal end of the loop cable, the loop connector being selectively engageable with the main connector;

a housing in which the loop connector is mounted;

a case fixed to the distal end of the loop cable, the case being selectively mechanically connectable to the enclosure and wherein the housing and case are selectively joined to one another to define a plug assembly.

2. The structure of claim 1 wherein the loop cable includes at least two wires which are electrically joined at their distal ends by a resistor mounted in the case.

3. The structure of claim 1 wherein the housing has a shoe and the case has a ledge, the shoe and ledge being selectively joined to one another by at least one fastener.

4. The structure of claim 1 wherein the enclosure includes a block therein which mounts the main connector.

5. The structure of claim 4 wherein the block is adjacent a passageway through the enclosure and wherein the case further comprises a prong extending therefrom, the prong extending through said passageway when the case is engaged with the enclosure.

6. In an alarm system having a base station connected to a main cable having at least first and second wires, a security loop cable assembly comprising:

an enclosure having at least one aperture for receiving the wires of the main cable therein;

a main connector electrically connected to at least one the wires of the main cable;

a loop cable having proximal and distal ends;

a loop connector attached to the proximal end of the loop cable, the loop connector being selectively engageable with the main connector;

a case fixed to the distal end of the loop cable, the case being selectively mechanically connectable to the enclosure and wherein the case further comprises a prong extending therefrom, the prong defining a comparison surface.

7. The structure of claim 6 wherein the enclosure includes a comparison surface located such that when the case is fully inserted into the enclosure the comparison surface of the prong will be co-planar with the comparison surface of the enclosure.

8. The structure of claim 6 wherein the enclosure defines an opening on one side thereof and the prong extends through said opening such that the comparison surface of the prong is visible on the outside of the enclosure.

9. In an alarm system having a base station connected to a main cable having at least first and second wires, a security loop cable assembly comprising:

a loop-receiving element having at least one aperture for receiving the wires of the main cable therein;

a main connector electrically connected to at least one of the wires of the main cable;

a loop cable having proximal and distal ends;

a loop connector attached to the proximal end of the loop cable, the loop connector being selectively engageable with the main connector;

a housing in which the loop connector is mounted;

a loop-closure element fixed to the distal end of the loop cable, the loop-closure element being selectively mechanically connectable to the loop-receiving element;

wherein the loop-receiving element is an enclosure having a space defined therein for receiving the loop-closure element and wherein the loop-closure element is a case surrounding the distal end of the loop cable; and wherein the housing and case are selectively joined to one another to define a plug assembly.

10. The structure of claim 9 wherein the loop-receiving element is an enclosure having a space defined therein for receiving the loop-closure element.

11. The structure of claim 10 wherein the enclosure includes a block therein which mounts the main connector.

12. The structure of claim 11 wherein the block is adjacent a passageway through the enclosure and wherein the case further comprises a prong extending therefrom, the prong extending through said passageway when the case is engaged with the enclosure.

13. The structure of claim 9 wherein the loop-closure element is a case surrounding the distal end of the loop cable.

14. The structure of claim 9 wherein the main connector is in the loop-receiving element.

15. The structure of claim 9 wherein the main connector is outside of the loop-receiving element.

16. The structure of claim 9 wherein the loop cable includes at least two wires which are electrically joined at their distal ends by a resistor mounted in the case.

17. The structure of claim 9 wherein the housing has a shoe and the case has a ledge, the shoe and ledge being selectively joined to one another by at least one fastener.

18. In an alarm system having a base station connected to a main cable having at least first and second wires, a security loop cable assembly comprising:

a loop-receiving element having at least one aperture for receiving the wires of the main cable therein;

a main connector electrically connected to at least one of the wires of the main cable;

a loop cable having proximal and distal ends;

a loop connector attached to the proximal end of the loop cable, the loop connector being selectively engageable with the main connector; and a loop-closure element fixed to the distal end of the loop cable, the loop-closure element being selectively mechanically connectable to the loop-receiving element;

wherein the loop-receiving element is an enclosure having a space defined therein for receiving the loop-closure element and wherein the loop-closure element is a case surrounding the distal end of the loop cable; and wherein the case further comprises a prong extending therefrom, the prong defining a comparison surface.

19. The structure of claim 18 wherein the enclosure includes a comparison surface located such that when the case is fully inserted into the enclosure the comparison surface of the prong will be co-planar with the comparison surface of the enclosure.

20. The structure of claim 18 wherein the enclosure defines an opening on one side thereof and the prong extends through said opening such that the comparison surface of the prong is visible on the outside of the enclosure.

* * * * *